United States Patent [19]

Fletcher

[11] 4,144,818

[45] Mar. 20, 1979

[54] STORAGE SYSTEM FOR WHEELED BUGGIES AND APPARATUS THEREFOR

[75] Inventor: Eldon L. Fletcher, Kingston, Canada

[73] Assignee: Du Pont of Canada Limited, Montreal, Canada

[21] Appl. No.: 811,984

[22] Filed: Jun. 30, 1977

[30] Foreign Application Priority Data

Aug. 16, 1976 [CA] Canada ..... 259140

[51] Int. Cl.[2] ..... B61J 3/04

[52] U.S. Cl. ..... 104/172 B; 104/162; 198/472; 414/262

[58] Field of Search ..... 104/172 R, 172 S, 172 B, 104/172 BT, 162, 147 R, 88; 105/4 R, 4 A; 57/58.55, 58.52; 214/16.4 C, 16.1 CD; 198/472, 793

[56] References Cited

U.S. PATENT DOCUMENTS

| | | | |
|---|---|---|---|
| 1,554,049 | 9/1925 | Thompson | 211/13 |
| 2,742,863 | 4/1956 | Burkitt | 104/172 B |
| 3,297,276 | 1/1967 | Skufca | 242/131 |
| 3,388,806 | 6/1968 | Cunningham | 211/13 |
| 3,409,141 | 11/1968 | Cunningham | 211/13 |
| 3,547,282 | 12/1970 | Hartbauer | 214/16.4 A |
| 3,552,693 | 1/1971 | Scharf | 242/131 |
| 3,568,950 | 3/1971 | Niwa | 242/131 |
| 3,738,506 | 6/1973 | Cornford et al. | 214/16.4 C |
| 3,773,191 | 11/1973 | Ishida | 57/52 |
| 3,927,773 | 12/1975 | Bright | 214/16.1 CD |

*Primary Examiner*—Robert G. Sheridan
*Assistant Examiner*—Randolph A. Reese

[57] ABSTRACT

An apparatus is disclosed for lagging (in-process storing) packages of textile yarn on wheeled buggies. At least one storage lane for textile yarn buggies is provided and a plurality of wheeled textile yarn buggies with connecting hooks having depending tail portions for joining the buggies together as a train are positioned in the storage lane. Air switch pads are provided at the exit from the storage lane for detecting the presence of a buggy. A driven chain with lugs thereon for moving the train of buggies forward one buggy length and then engaging the depending portion of the hooks for disconnecting the buggy nearest the exit from the remainder of the train is actuated by a signal from the air switch pads each time the air switch pads fail to detect the presence of a buggy.

13 Claims, 4 Drawing Figures

STORAGE SYSTEM FOR WHEELED BUGGIES AND APPARATUS THEREFOR

BACKGROUND OF THE INVENTION

This invention relates to a system for lagging textile yarn stored on wheeled buggies and more particularly to a yarn lagging system in which yarn buggies are releasably connected in trains arranged in lanes, the trains being adapted to be indexed or moved forward one buggy length at a time.

As used herein the term "lagging" means the in-process storing of yarn. Such in-process storing of yarn may occur, for example, while waiting for the completion of various tests which may be performed on the yarn prior to release of the yarn to the next process step or while holding the yarn in a controlled atmosphere to obtain the moisture level required in the yarn for further processing.

The practice of handling packages of textile yarn on wheeled buggies, trucks or carts, hereinafter referred to as buggies, is known in the art. These buggies, which have pegs, arms or trays for holding the packages in transit, are maneuverable, in that they need follow no set travel pattern, and are inexpensive. In use, the yarn buggies have heretofore usually been pushed manually, but have also been hooked together as trains and towed with a vehicle such as a tractor. The yarn buggies have also been moved individually by an in-floor conveyor system.

In prior art systems for lagging yarn on buggies, the buggies containing the yarn are often assembled in groups or blocks which may relate to a production time period. Generally the preferred mode of operation is to handle the yarn buggies on a first in, first out basis. However, unless adequate aisle space is provided for on at least two sides of each block of lagged buggies, this mode of operation is often difficult to maintain. Moreover, when lagging is provided to hold the yarn in a controlled atmosphere to obtain a particular moisture level in the yarn, it is frequently necessary to maintain an additional lagging area set aside to receive newly produced yarn so that it does not get mixed with the yarn produced earlier.

Recently a system of lagging yarn in packages has evolved in which yarn packages are placed in racks traveling on overhead monorail tracks. Lagging of the yarn is achieved by providing a series of spur lines each holding a given number of racks. Disadvantages of the system employing the overhead monorail are that it is expensive, inflexible and may be difficult to install in an existing manufacturing plant where roof structures may require reinforcing before installation and where physical obstructions such as ductwork are frequently encountered.

It is an object of the present invention to provide a system for lagging textile yarn, which is inexpensive and which allows the yarn to be conveniently handled on a first in, first out basis.

Surprisingly it has now been found that the above object may be achieved and the above disadvantages of the prior art systems overcome by arranging yarn buggies in lanes, the yarn buggies in each lane being releasably connected together in a train, which is adapted to be automatically moved forward one buggy length when the front buggy is removed from the lane.

SUMMARY OF THE INVENTION

Accordingly, the present invention provides an apparatus for lagging textile yarn on wheeled buggies comprising

- at least one storage lane for textile yarn buggies, the storage lane having an inlet and an exit,
- a plurality of wheeled textile yarn buggies having connecting means for joining the buggies together as a train in the storage lane,
- buggy detecting means at the exit from the storage lane for detecting the presence of a buggy,
- an indexing means for moving the train of buggies forward at least one buggy length and disconnecting means for disconnecting the buggy nearest the exit from the remainder of the train, the indexing means and the disconnecting means being actuated by a signal from the buggy detecting means each time the detecting means fails to detect the presence of a buggy.

In one embodiment of the apparatus of the present invention, the indexing means also serves as the disconnecting means.

In another embodiment the connecting means comprises a connecting hook attached to the front frame of each buggy in the train, the connecting hook having a head portion adapted to be received in a hole in a plate attached to the rear frame of the immediately preceding buggy in the train.

In yet another embodiment the connecting hook also has a mid-portion and a tail portion and the connecting hook is pivotally mounted at its mid-portion on a horizontal shaft and is adapted to be pivoted on the shaft such that its head portion moves from a substantially horizontal position for use to a substantially upright position for storage.

In a further embodiment the tail portion of the connecting hook depends beneath the front frame of the buggy when the head portion of the connecting hook is in the substantially horizontal position for use.

In a still further embodiment a push bar is attached to the front frame of each buggy in the train and depends therefrom beneath the buggy.

In yet a further embodiment the indexing and disconnecting means comprises at least one lug mounted on a carrier means positioned under the storage lane near the exit, the carrier means being adapted, on signal from the buggy detecting means, to move the lug such that the lug first engages the tail portion of the connecting hook depending beneath the front frame of the buggy immediately behind the buggy nearest the exit and pivots the connecting hook on the shaft thus removing its head portion from the hole in the plate attached to the rear frame of the buggy nearest the exit and moves it to its substantially upright storage position, and the lug then engages the push bar depending from the first frame of the buggy immediately behind the buggy nearest the exit and moves it and the train connected thereto forward one buggy length, the buggy nearest the exit also being moved forward one buggy length, by the front frame of the buggy immediately behind, to the exit of the lane where it is detected by the buggy detecting means.

DETAILED DESCRIPTION OF THE PREFERRED EMBODIMENT

Figure 1:
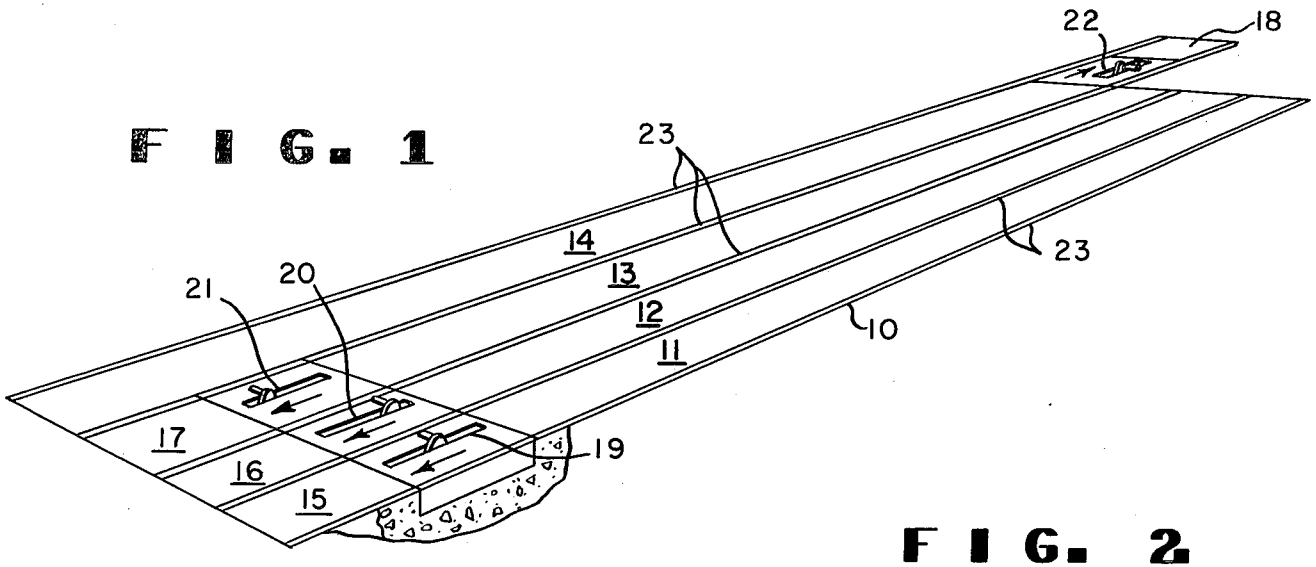
FIG. 1 is a schematic view of an embodiment of the present invention showing several storage lanes for textile yarn buggies.

In FIG. 1 of the drawings, an embodiment of the present invention for lagging textile yarn on wheeled buggies is indicated generally by the numeral 10. Three storage lanes 11, 12 and 13 are provided for full textile yarn buggies and one buggy return lane 14 is provided for returning empty yarn buggies and a yarn spinning area. Buggy detecting means 15, 16, 17 and 18, which may comprise air switch pads (e.g. RBMA Controflex Roadswitch manufactured by Tape Switch Corporation of America, Farmingdale, New York) or other detecting devices, are positioned at the exits from lanes 11, 12, 13 and 14 respectively. Lane indicators 23, e.g. strips of colored tape or painted lines are provided to designate lanes 11, 12, 13 and 14 as such.

Figure 4:
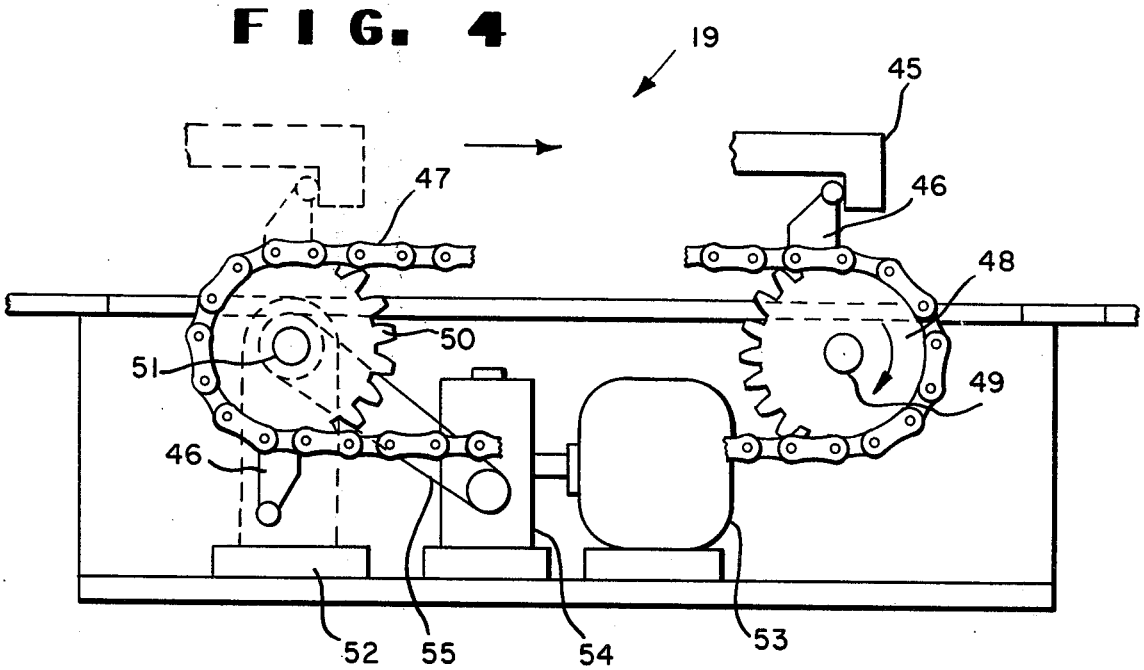
FIG. 4 is a schematic view of an embodiment of an indexing means for moving a train of textile yarn buggies forward one buggy length.

Each indexing means 19, 20, 21 and 22, which in this embodiment comprise a plurality of lugs mounted on a continuous chain, are recessed into the floor of a lane (as shown in FIG. 4 and described hereinafter with respect to the indexing means 19). Each of these indexing means is adapted to move a train of buggies forward one buggy length.

Figure 2:
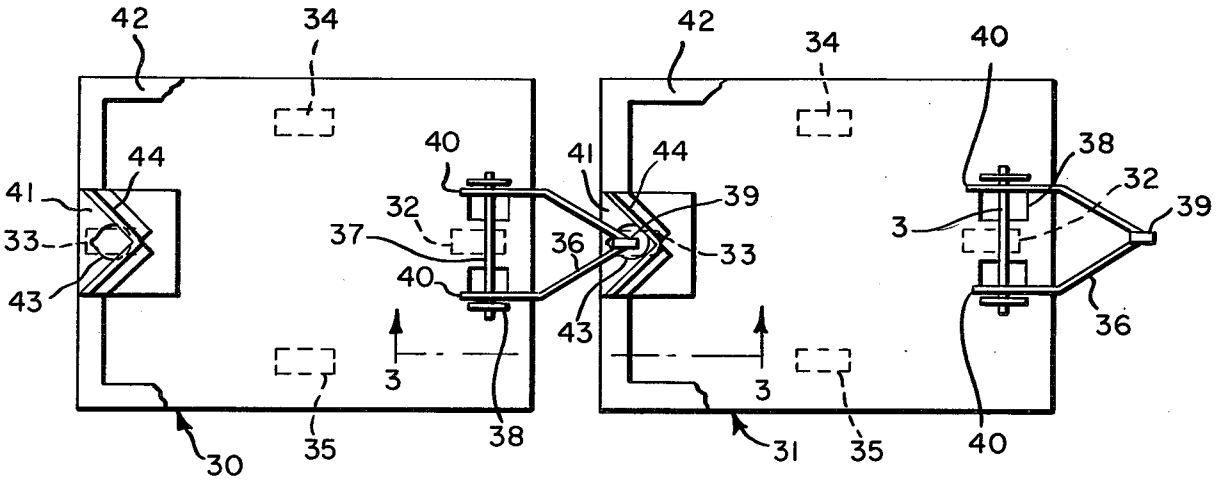
FIG. 2 is a plan view of an embodiment of connecting means for joining textile yarn buggies together as a train.
Figure 3:
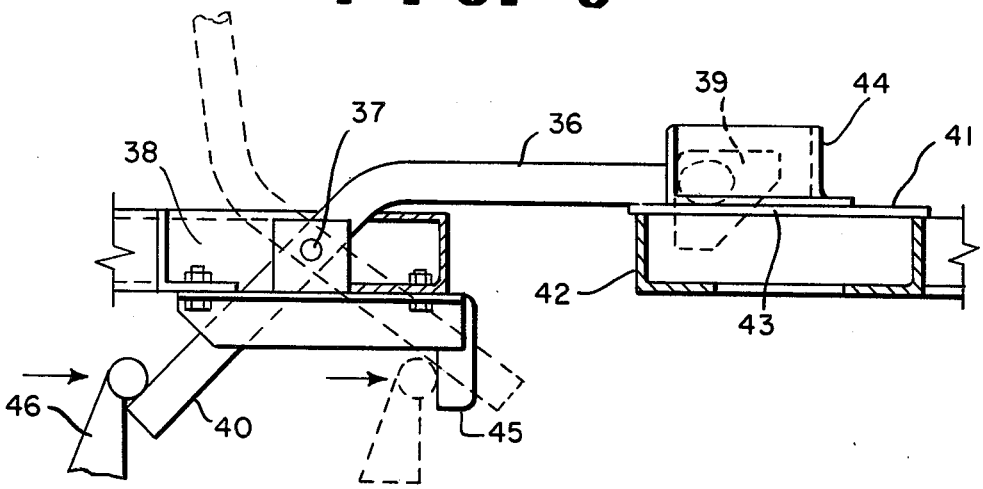
FIG. 3 is a partial elevation of the connecting means shown in FIG. 2 viewed in the direction of arrows 3-3, and also shows an embodiment of a disconnecting means.

In each of lanes 11, 12, 13 and 14, a plurality of textile yarn buggies (not shown) are connected in trains by connecting means shown in FIGS. 2 and 3. FIG. 2 shows in outline two textile yarn buggies 30 and 31, each having a pair of swivel wheels 32 and 33 disposed respectively at the front and back thereof and a pair of fixed wheels 34 and 35 disposed respectively on the opposite sides thereof. A wishbone-shaped connecting hook 36 (see also FIG. 3) is pivotably mounted on a horizontal shaft 37 attached to the frame 38 at the front of buggies 30 and 31. Connecting hook 36 has a lead portion 39 and twin tail portions 40. Connecting hook 36 is adapted to be stored with its head portion 39 in an upright position against the buggy frame when not in use and to be flipped down such that its head portion 39 is in a horizontal position for use. When the head portion 39 is in such a horizontal position, the tail portions 40 of connecting hook 36 depend beneath the frame of the buggy to a point a few inches above the floor (see FIG. 3).

A plate 41 is attached to the frame 42 at the rear of buggies 30 and 31. A hole 43 in plate 41 receives head portion 39 of connecting hook 36, head portion 39 being guided into hole 43 by a V-shaped guide 44 positioned on plate 41.

A push bar 45 (see FIG. 3) is attached to the frame 38 at the front of each buggy and depends therefrom to a point a few inches above the floor. Push bar 45 is adapted to be engaged by a lug 46 of the indexing means shown in FIG. 4 and described hereinafter. Lug 46 of the indexing means is also adapted to engage one of the depending tail portions 40 of connecting hook 36 and to pivot connecting hook 36 about shaft 37 such that head portion 43 of connecting hook 36 is disconnected from hole 43 in plate 41 attached to frame 42 at the rear of the front buggy and is positioned in an upright position for storage.

In FIG. 4 an indexing means of the type indicated by numerals 19, 20, 21 and 22 in FIG. 1, is designated generally by the numeral 19. A plurality of lugs 46 are mounted on a continuous chain 47. Chain 47 is supported at one end by a sprocket 48 on shaft 49 and is supported at the other end by a driven sprocket 50 on shaft 51, which is supported by a pillow block 52. Driven sprocket 50 is powered by a motor 53 through a gear reducer 54 and a pulley-belt system 55. Indexing means 19 is adapted to move at a low speed, e.g. 3 meters/minute, whenever motor 53 is started by a signal from a buggy detecting means, e.g. of the type designated by the numerals 15, 16, 17 and 18 in FIG. 1. After a suitable time delay, e.g. 15 or 20 seconds, the buggy detecting means signals the motor 53 to stop.

The embodiment of the present invention shown in FIG. 1 for lagging textile yarn on wheeled buggies in three storage lanes is designed for three shift operation with a 24 hour lagging time. It will be appreciated that a system using two storage lanes is convenient for two shift operation and that if desired a system using one storage lane may be employed for various types of shift operation. In the three shift operation, a lane of full buggies (e.g. lane 11, lane 12 or lane 13) is assigned to each shift and the first full buggy put into the lane at the start of each shift is clearly marked. In the embodiment shown the lanes are separated by lane indicators 23. If desired, for example, where the lanes are of minimum width, lane dividers, for example angle irons attached to the floor may be substituted for lane indicators 23.

The operation will now be described with regard to the shift during which lane 11 is used. In operation, the operator responsible for taking the yarn from the train of buggies in lane 11 for further processing approaches an empty textile yarn buggy from which he has just completed removing the yarn packages and pivots connecting hook 36 (see also FIGS. 2 and 3) at the front thereof from its vertical storage position to its horizontal position for use. He then pushes the buggy into buggy return lane 14. As the front of the buggy approaches the rear of the last buggy of the train of empty buggies in lane 14, the slanted head portion 39 of connecting hook 36 rides up over plate 41 and is guided into hole 43 therein by V-shaped guide 44. The empty buggy is now connected to the train of empty buggies in lane 14. The buggies shown in FIG. 2 are four wheeled buggies with swivel wheels 32 and 33 at the front and the back thereof respectively, and the connecting hook 36 is wishbone-shaped in order to straddle the front wheel 32. It will be appreciated that for four or six wheeled buggies on which wheels are positioned at the corners, a connecting hook comprising a single member is satisfactory.

Having disposed of the empty buggy, the operator goes to the exit from lane 11 and removes the front buggy therefrom, the front buggy having been disconnected from the train of full buggies in lane 11 as will be described hereinafter. As soon as the front buggy is removed from lane 11, buggy detecting means 15 sends a signal which starts motor 53 of indexing means 19 (see FIG. 4). Motor 53, through gear reducer 54, pulley-belt system 55 and driven sprocket 50, moves continuous chain 47 having lugs 46 mounted thereon at a low speed, e.g. 3 meters/minute. After a suitable time delay, e.g. 15 or 20 seconds, buggy detecting means 15 signals the motor 53 to stop.

When continuous chain 47 begins to move, lugs 46 mounted thereon act on the second buggy from the front of the train of full buggies then remaining in lane 11 as follows (see FIG. 3). A moving lug 46 first engages one of the depending tail portions 40 of connecting hook 36 of the second buggy and pivots it on shaft 37. Head portion 39 of connecting hook 36 is thus removed from hole 43 in plate 41, which is attached to the frame 42 at the rear of the front buggy, and is moved to its upright storage position. The front buggy is now disconnected from the train. As the lug 46 continues to move it engages push bar 45 attached to frame 38 of the second buggy from the front and pulls this buggy and the whole train connected thereto forward one buggy length, sprocket 48 and driven sprocket 50 (which support chain 47) being positioned such that lug 46 engages push bar 45 for this distance. The front buggy, which is now disconnected from the train is pushed forward one buggy length (by the frame 38 of the second buggy from the front) to the exit from lane 11 where it is detected by buggy detecting means 15. It will be appreciated that the buggy detecting means 15 may be adapted to signal motor 53 to stop immediately when it detects the presence of the front buggy rather than acting after a time delay as described above. The front buggy is now in position for removal by the operator.

Meanwhile at the inlet end of the storage lanes a spinning area operator connects (see FIG. 1) a full yarn buggy, which he has just completed filling with yarn packages, to the rear of the last buggy of the train of full buggies in lane 11 as described above for connecting the empty buggy to the train of empty buggies in lane 14. Having disposed of the full buggy, the spinning area operator goes to the exit from lane 14 and removes the front empty buggy therefrom. As soon as the front buggy is removed from lane 14, the buggy detecting means 18 sends a signal to indexing means 22 and the train of empty buggies is moved ahead one buggy length as described above for the indexing of the train of full buggies in lane 11.

In the embodiment shown and described heretofore the carrier means for the lugs 46 of the indexing means 19 (see FIG. 4) is the continuous chain 47 which is supported on the sprocket 48 and the driven sprocket 50, the driven sprocket 50 being powered by the motor 53 through the gear reducer 54 and the pulley-belt system 55. It will be appreciated that other carrier means may be provided for lugs 46. For example, a single lug may be pivotably mounted on a carriage which is moved forward and back one buggy length by a double acting cable cylinder. In this arrangement, the lug is adapted to remain upright and to engage tail portion 40 of connecting hook 36 and push bar 45 of a buggy as the carriage moves forward while the train is being indexed, and is adapted to pivot to a lay-flat position as the carriage moves back one buggy length to its starting position.

It will also be appreciated that when handling trains of buggies which are four wheeled buggies with swivel wheels 32 and 33 at the front and back thereof respectively (as indicated in FIG. 2), it may be advantageous to provide indexing means having twin lugs (adapted to move in unison) in the lane on the opposite sides of the swivel wheels. In this arrangement, twin push bars would depend from the front frame of each buggy, and during indexing of the train of buggies, the twin lugs would engage both depending tail portions of the connecting hook and would also engage the twin push bars. The twin lugs may be carried by twin continuous chains mounted in parallel or the twin lugs may be mounted on the opposite sides of a carriage, which is moved forward and back one buggy length by a double acting cable cylinder, as described hereinbefore.

What is claimed is:

1. Apparatus for lagging textile yarn on wheeled buggies comprising:

at least one storage lane for textile yarn buggies, the storage lane having an inlet and an exit;

a plurality of wheeled textile yarn buggies having connecting means for joining the buggies together as a train in the storage lane;

means located at the exit from the storage lane for detecting the presence of a buggy; and means located in the storage lane and adjacent to the detector means for moving the train of buggies forward at least one buggy length and for displacing the connecting means of the buggy nearest the exit so as to disconnect it from the remainder of the train, said means for moving being actuated by the buggy detecting means each time the buggy detecting means fails to detect the presence of a buggy.

2. The apparatus according to claim 1 wherein the buggy detecting means comprises an air switch pad.

3. The apparatus according to claim 1 wherein the connecting means comprises a connecting hook attached to the front frame of each buggy in the train, the connecting hook having a head portion adapted to be received on a hole in a plate attached to the rear frame of the immediately preceding buggy in the train.

4. The apparatus according to claim 3 wherein the connecting hook also has a mid-portion and a tail portion and wherein the connecting hook is pivotably mounted at its mid-portion on a horizontal shaft and is thus adapted to be pivoted on the shaft such that its head portion moves from a substantially horizontal position for use in joining the buggies to a substantially upright position for storage.

5. The apparatus according to claim 4 wherein the tail portion of the connecting hook depends beneath the front frame of the buggy when the head portion of the connecting hook is in the substantially horizontal position for use.

6. The apparatus according to claim 5 wherein a push bar is attached to the front frame of each buggy in the train and depends therefrom beneath the buggy.

7. The apparatus according to claim 6 wherein the indexing and disconnecting means comprises at least one lug mounted on a carrier means positioned under the storage lane near the exit, the carrier means being adapted, on signal from the buggy detecting means, to move the lug such that the lug first engages the tail portion of the connecting hook depending beneath the front frame of the buggy immediately behind the buggy nearest the exit and pivots the connecting hook on the shaft, thus removing its head portion from the hole in the plate attached to the rear frame of the buggy nearest the exit and moves it to its substantially upright storage position, and the lug then engages the push bar depending from the front frame of the buggy immediately behind the buggy nearest the exit and moves it and the train connected thereto forward one buggy length, the buggy nearest the exit also being moved forward one buggy length, by the front frame of the buggy immediately behind, to the exit of the lane where it is detected by the buggy detecting means.

8. The apparatus according to claim 7 wherein the carrier means comprises a continuous chain supported by two sprockets, one of the sprockets being a driven sprocket powered by a motor through a gear reducer and pulley-belt system.

9. The apparatus according to claim 8 wherein the two sprockets are separated by a distance such that the lug engages the push bar while the train is moved one buggy length.

10. The apparatus according to claim 1, wherein there are at least two storage lanes for textile yarn buggies.

11. The apparatus according to claim 1, wherein there are three storage lanes for textile yarn buggies.

12. The apparatus according to claim 1, wherein there are at least two storage lanes for full textile yarn buggies and one buggy return lane for returning empty yarn buggies.

13. The apparatus according to claim 1, wherein there are three storage lanes for full textile yarn buggies and one buggy return lane for returning empty yarn buggies.

* * * * *